US012485306B1

(12) United States Patent
Yu

(10) Patent No.: US 12,485,306 B1
(45) Date of Patent: Dec. 2, 2025

(54) ADJUSTABLE DUMBBELL AND DUMBBELL KIT

(71) Applicant: Zhejiang Zuojian Industry and Trade Co., Ltd., Jinhua (CN)

(72) Inventor: Zhaohong Yu, Yongkang (CN)

(73) Assignee: Zhejiang Zuojian Industry and Trade Co., Ltd., Jinhua (CN)

( * ) Notice: Subject to any disclaimer, the term of this patent is extended or adjusted under 35 U.S.C. 154(b) by 0 days.

(21) Appl. No.: 19/307,480

(22) Filed: Aug. 22, 2025

(30) Foreign Application Priority Data

Apr. 25, 2025 (CN) ..... 202520799172.3

(51) Int. Cl.
*A63B 21/072* (2006.01)
*A63B 21/06* (2006.01)
*A63B 21/075* (2006.01)

(52) U.S. Cl.
CPC ..... *A63B 21/0726* (2013.01); *A63B 21/0604* (2013.01); *A63B 21/0728* (2013.01); *A63B 21/075* (2013.01)

(58) Field of Classification Search
CPC ..... A63B 21/0726; A63B 21/0604; A63B 21/0728; A63B 21/075
See application file for complete search history.

(56) References Cited

U.S. PATENT DOCUMENTS 6,186,928 B1 * 2/2001 Chen ..... A63B 21/0728 482/107
6,228,003 B1 * 5/2001 Hald ..... A63B 21/075 482/107
6,261,022 B1 * 7/2001 Dalebout ..... A63B 21/075 482/107
7,011,611 B1 * 3/2006 Ripley ..... A63B 21/0728 482/107
9,925,408 B1 * 3/2018 Murdock ..... A63B 21/4043
11,383,121 B1 * 7/2022 Olson ..... A63B 21/154
12,440,715 B2 * 10/2025 Lewis-Dove ..... A63B 21/0726
2002/0002106 A1 * 1/2002 Krull ..... A63B 21/075 482/107
2002/0022559 A1 * 2/2002 Krull ..... A63B 21/0728 482/106
2002/0183174 A1 * 12/2002 Chen ..... A63B 21/075 482/108
2003/0096683 A1 * 5/2003 Fenelon ..... A63B 21/075 482/107

(Continued)

*Primary Examiner* — Sundhara M Ganesan
(74) *Attorney, Agent, or Firm* — JEEN IP LAW, LLC

(57) ABSTRACT

A novel adjustable dumbbell and a dumbbell kit are provided, the adjustable dumbbell includes a dumbbell body, the dumbbell body includes a dumbbell grip rod, and dumbbell shells sleeved on two ends of the dumbbell grip rod and connected to the two ends of the dumbbell grip rod; one or more dumbbell pieces installed on the dumbbell body, each of the dumbbell pieces is provided with one or more dumbbell grooves; and an adjusting mechanism provided on the dumbbell body, the adjusting mechanism includes one or more adjusting blocks, the adjusting blocks include one or more adjusting portions, the number of the adjusting portions corresponds to the number of the dumbbell pieces, and each of the adjusting portions slides and cooperates with the adjustment mechanism. This application has effects of improving the weight adjustment efficiency of the adjustable dumbbell.

10 Claims, 16 Drawing Sheets

(56) References Cited

U.S. PATENT DOCUMENTS

2003/0144117 A1* 7/2003 Krull ..... A63B 21/0728 482/106
2004/0005969 A1* 1/2004 Chen ..... A63B 21/063 482/107
2004/0162197 A1* 8/2004 Towley, III ..... A63B 21/0722 482/106
2004/0220025 A1* 11/2004 Krull ..... A63B 21/063 482/94
2006/0135328 A1* 6/2006 Doudiet ..... A63B 21/0728 482/107
2006/0234843 A1* 10/2006 Chen ..... A63B 21/075 482/107
2008/0146420 A1* 6/2008 Chen ..... A63B 21/0728 482/108
2009/0036278 A1* 2/2009 Towley, III ..... A63B 21/075 482/107
2009/0305852 A1* 12/2009 Hoglund ..... A63B 21/075 482/107
2010/0304939 A1* 12/2010 Svenberg ..... A63B 21/075 482/108
2013/0231224 A1* 9/2013 Svenberg ..... A63B 21/072 482/107
2018/0117387 A1* 5/2018 Wang ..... A63B 21/072
2020/0360757 A1* 11/2020 Flick ..... A63B 71/0054
2021/0023411 A1* 1/2021 Wang ..... A63B 21/075
2022/0040520 A1* 2/2022 Tran ..... A63B 21/0726
2022/0054891 A1* 2/2022 Owusu ..... A63B 24/0062
2022/0249899 A1* 8/2022 Olson ..... A63B 21/075
2022/0401785 A1* 12/2022 Gottehrer ..... A63B 21/0728
2022/0409945 A1* 12/2022 Bhandarkar ..... A63B 21/0726
2023/0027679 A1* 1/2023 Chen ..... A63B 21/075
2023/0293932 A1* 9/2023 Chang ..... A63B 21/0726 482/107
2023/0347200 A1* 11/2023 Casagrande ..... A63B 21/075
2024/0181287 A1* 6/2024 Pohl ..... A63B 21/075
2024/0325814 A1* 10/2024 Lewis-Dove ..... A63B 21/075
2024/0382796 A1* 11/2024 Liu ..... A63B 21/075
2025/0235734 A1* 7/2025 Dunbar ..... A63B 21/075
2025/0242190 A1* 7/2025 Collner ..... A63B 21/075
2025/0269222 A1* 8/2025 Liu ..... A63B 21/0728
2025/0281788 A1* 9/2025 Wang ..... A63B 21/075

* cited by examiner

ADJUSTABLE DUMBBELL AND DUMBBELL KIT

CROSS-REFERENCE TO RELATED APPLICATIONS

This application claims priority to Chinese Patent Application No. 202520799172.3, filed on Apr. 25, 2025, which is hereby incorporated by reference in its entirety.

TECHNICAL FIELD

The present disclosure relates to the field of dumbbell technologies, and in particular, to a new type of adjustable dumbbell and a dumbbell kit.

BACKGROUND

Dumbbells are widely used as fitness equipment, especially those that can easily adjust weight, which are favored by many fitness enthusiasts. Users need to frequently adjust different weights or numbers of dumbbell pieces to achieve various weight adjustments.

At present, the commonly used adjustable dumbbells generally include a dumbbell body and a plurality of dumbbell pieces cumulatively installed on the dumbbell body. The dumbbell body includes dumbbell shells and a dumbbell grip rod. The dumbbell shells are provided with a plurality of adjustment holes that are penetrated, and each adjustment hole is distributed along a height direction of the dumbbell shells. When the dumbbell body and the dumbbell grip rod are connected, the dumbbell grip rod penetrates through any adjustment hole, and each of the dumbbell pieces is provided with a dumbbell hole that is penetrated. Each dumbbell hole is directly opposite and connected to each adjustment hole. When the dumbbell grip rod penetrates through any adjustment hole, the dumbbell grip rod simultaneously penetrates through the corresponding dumbbell hole of the adjustment hole, so that the number of dumbbell pieces accumulated in the dumbbell body is the dumbbell pieces connected to the dumbbell grip rod and the dumbbell pieces that are in contact with the dumbbell shells. When adjusting the weight of the dumbbell, it is necessary to disconnect the dumbbell grid rod from the dumbbell shells, in order to replace the adjustment hole that is penetrated by the dumbbell grip rod, and adjust the number of dumbbell pieces between the dumbbell pieces connected to the dumbbell grip rod and the dumbbell pieces in contact with the dumbbell shells, thus completing the weight adjustment of the dumbbell.

Regarding the relevant technologies mentioned above, although adjusting the dumbbell achieves weight adjustment, it requires the user to first detach the dumbbell grip rod from the dumbbell shells and then determine the position of the adjustment hole for the dumbbell grip rod to penetrate according to required weight adjustment of the dumbbell. This results in a laborious process for adjusting the weight of the dumbbell, leading to low efficiency in weight adjustment and difficulty in frequently adjusting the weight of the dumbbell, thereby affecting the exercise effect of using the dumbbell.

SUMMARY

In order to improve weight adjustment efficiency of adjustable dumbbells, this application provides a new type of adjustable dumbbell and a dumbbell kit.

The adjustable dumbbell and dumbbell kit provided in this application adopts the following technical solution.

A new type of adjustable dumbbell, including:

a dumbbell body, the dumbbell body includes a dumbbell grip rod and dumbbell shells that are sleeved on two ends of the dumbbell grip rod and connected to the two ends of the dumbbell grip rod;

one or more dumbbell pieces that are provided on the dumbbell body, each of the dumbbell pieces is provided with one or more dumbbell grooves; and an adjusting mechanism that is provided on the dumbbell body, the adjusting mechanism includes one or more adjusting blocks, the adjusting blocks include one or more adjusting portions, the number of the adjusting portions corresponds to the number of the dumbbell pieces, and each of the adjusting portions cooperates with the dumbbell shells;

when the adjusting blocks slide away from the dumbbell body, each of the adjusting portions is inserted into corresponding dumbbell groove of each of the dumbbell pieces, so that the dumbbell pieces are accumulated on the dumbbell body.

By adopting the above technical solution, when adjusting the weight of the dumbbell, the adjusting blocks are driven to slide in a direction away from the dumbbell body, so that the adjusting portions that need to accumulate the number of dumbbell pieces are penetrated through each dumbbell groove, thereby enabling accumulated dumbbell pieces to be installed on the dumbbell body, and quickly completing the weight adjustment of the adjustable dumbbell. This improves the problem that although the adjustable dumbbell achieves weight adjustment, the user needs to first detach the dumbbell grip rod from the dumbbell shells, and then determine the position of the adjustment hole for the dumbbell grip rod to pass through according to required weight adjustment of the dumbbell, which makes it difficult and laborious to adjust the weight of the dumbbell, resulting in low efficiency in frequent weight adjustment of the dumbbell and affecting the exercise effect of using the dumbbell.

In an embodiment of the present disclosure, the adjusting blocks further include fixing portions, and the fixing portions are slidably fitted to the dumbbell shells, each of the adjusting portions is fixedly provided on the fixing portions, and the adjusting portions are distributed along a length direction of the fixing portions.

In an embodiment of the present disclosure, a length of each of the adjusting portions gradually increase or decrease from one end of the fixing portions to the other end of the fixing part in a length direction.

In an embodiment of the present disclosure, the dumbbell grip rod includes one or two sliding rods, each of the sliding rods is slidably fitted to the dumbbell shells;

when each of the sliding rods slides towards or away from the dumbbell body, each of the adjusting blocks slides towards or away from the dumbbell body;

a central rod is rotatably provided on the dumbbell shells;

one or two threaded rods, each of the one or two threaded rods is fixedly connected to the central rod; when the central rod is rotated, each of the threaded rods is rotated, and each of the threaded rods is threaded and connected to each of the sliding rods.

In an embodiment of the present disclosure, the number of the adjusting blocks corresponds to the number of the sliding rods, the fixing portions are fixedly provided with a fixing convex block, the sliding rod is provided with a fixing groove, and when the fixing portions are fixedly connected to the sliding rod, the fixing convex block is inserted and clamped into the fixing groove.

In an embodiment of the present disclosure, the adjusting mechanism further includes a shifting component, where the shifting component includes:

a shifting wheel that is fixedly provided on the dumbbell shells, and the shifting wheel is provided with a plurality of shifting holes, each of the shifting holes is distributed around an axis of the shifting wheel in a circumferential direction;

one or more shifting balls, and the shifting balls slide along an axis direction and fit on the central rod, and are configured to engage with any of the shifting holes; and shifting springs, the number of the shifting springs corresponds to the number of the shifting balls, one end of each of the shifting springs is connected to the center rod, and the other end of each of the shifting springs is connected to the shifting balls;

when adjusting a weight of the dumbbell, the shifting balls are disengaged from one shifting hole and pass through another shifting hole.

In an embodiment of the present disclosure, the dumbbell shells are provided with a plurality of sets of scale holes that are penetrated, the number of the scale holes corresponds to the number of the adjusting blocks, the scale holes include a plurality of scale portions, and the number of the scale portions corresponds to the number of the dumbbell pieces;

one side of each of the scale portions is engraved with adjusting scales of different weights;

each of the adjusting blocks is fixedly connected to a scale block, and when the scale block faces any one scale portion, an adjusting scale on the side facing the scale portions is the weight of the adjustable dumbbell.

In an embodiment of the present disclosure, the adjusting mechanism further includes a locking component, the locking component includes:

a locking wheel, the locking wheel is coaxially fixed on the central rod, the locking wheel is provided with a plurality of locking grooves, and each of the locking grooves is distributed around an axis of the locking wheel in a circumferential direction; and a locking block, and the locking block slides along a vertical direction and fits with the dumbbell shells; the locking block is fixedly connected to a locking protrusion; when the locking component is locked, the locking protrusion is inserted and clamped into any of the locking slots to fix the center rod and the dumbbell shells.

A dumbbell kit, including the adjustable dumbbell and a dumbbell seat configured to place the adjustable dumbbell, and the dumbbell seat is provided with a placement groove configured to place the adjustable dumbbell.

In an embodiment of the present disclosure, an unlocking block configured to unlock the locking component is provided in the placement groove, and when the adjustable dumbbell is placed on the dumbbell seat, the unlocking block contacts the locking block and pushes the locking block to be away from the locking wheel, so that the locking protrusion disengages from the locking slot so as to unlock the locking component.

In summary, this application includes at least one beneficial technical effect as follows.

When adjusting the weight of the dumbbell, the adjusting blocks are driven to slide in a direction away from the dumbbell body, so that the adjusting portions that need to accumulate the number of dumbbell pieces are penetrated through each dumbbell groove, thereby enabling accumulated dumbbell pieces to be installed on the dumbbell body, and quickly completing the weight adjustment of the adjustable dumbbell. This improves the problem that although the adjustable dumbbell achieves weight adjustment, the user needs to first detach the dumbbell grip rod from the dumbbell shells, and then determine the position of the adjustment hole for the dumbbell grip rod to pass through according to required weight adjustment of the dumbbell, which makes it difficult and laborious to adjust the weight of the dumbbell, resulting in low efficiency in frequent weight adjustment of the dumbbell and affecting the exercise effect of using the dumbbell.

Numeral reference: 1—dumbbell body; 11—dumbbell grip rod; 111—sliding rod; 1111—fixing groove; 112—center rod; 1121—friction sleeve; 113—threaded rod; 12—dumbbell shell; 121—scale hole; 1211—scale portion; 1212—adjusting scale; 122—fixing block; 123—sliding column; 2—dumbbell piece; 21—dumbbell groove; 3—adjusting mechanism; 31—adjusting block; 311—adjusting portion; 312—fixing portion; 3121—fixing convex block; 31211—first arc-shaped portion; 31212—second arc-shaped portion; 313—scale block; 32—locking component; 321—locking wheel; 3211—locking slot; 322—locking block; 3221—sliding groove; 3222—locking protrusion; 3223—unlocking protrusion; 323—locking spring; 33—shifting component; 331—shifting wheel; 3311—shifting hole; 332—shifting ball; 333—shifting spring; 10—adjustable dumbbell; 20—dumbbell seat; 200—unlocking block.

DESCRIPTION OF EMBODIMENTS

Further detailed explanation of the present application will be provided in combination with FIGS. 1-16.

Figure 1:
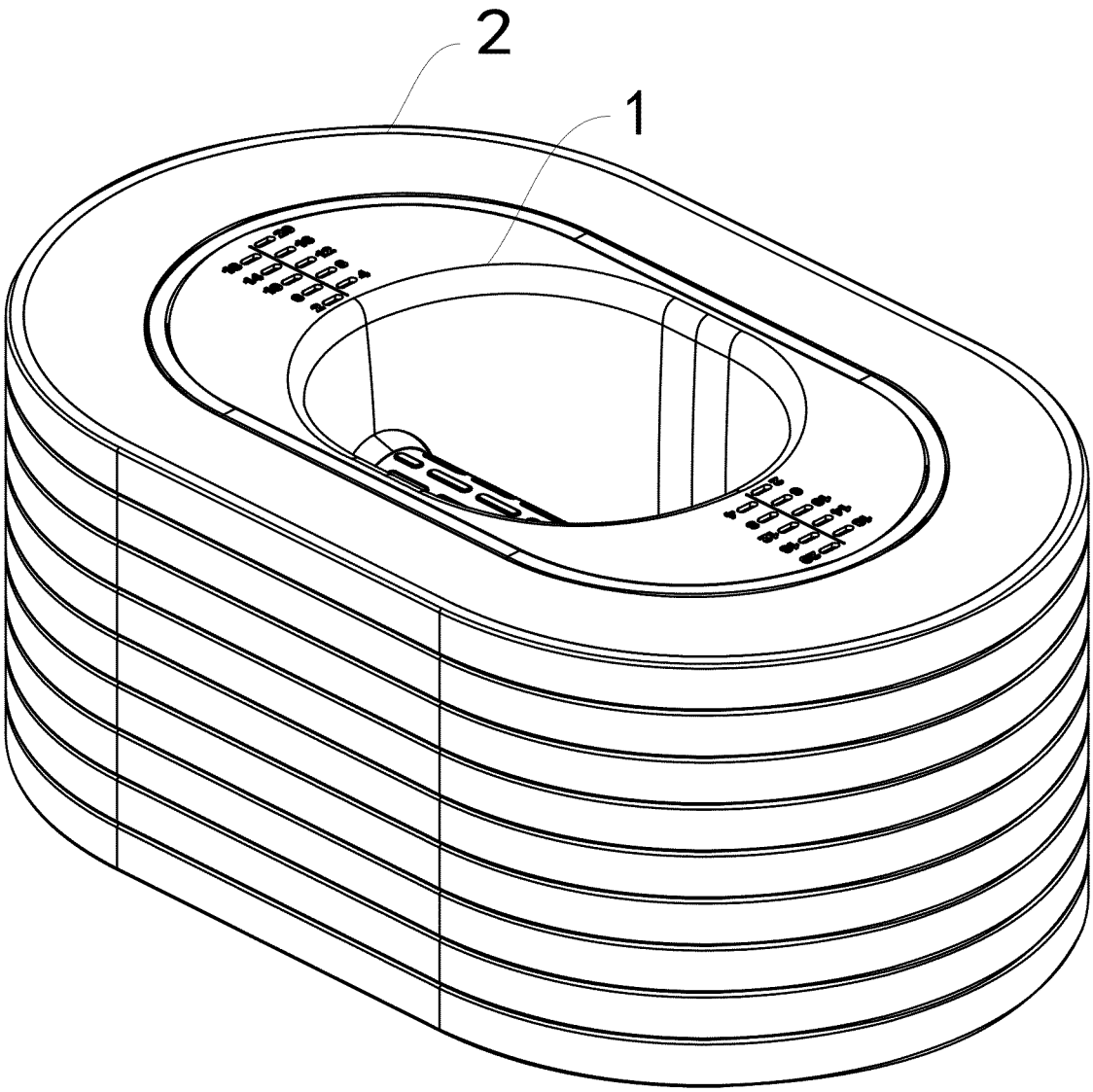
FIG. 1 is a schematic diagram of an overall structure of an adjustable dumbbell.
Figure 2:
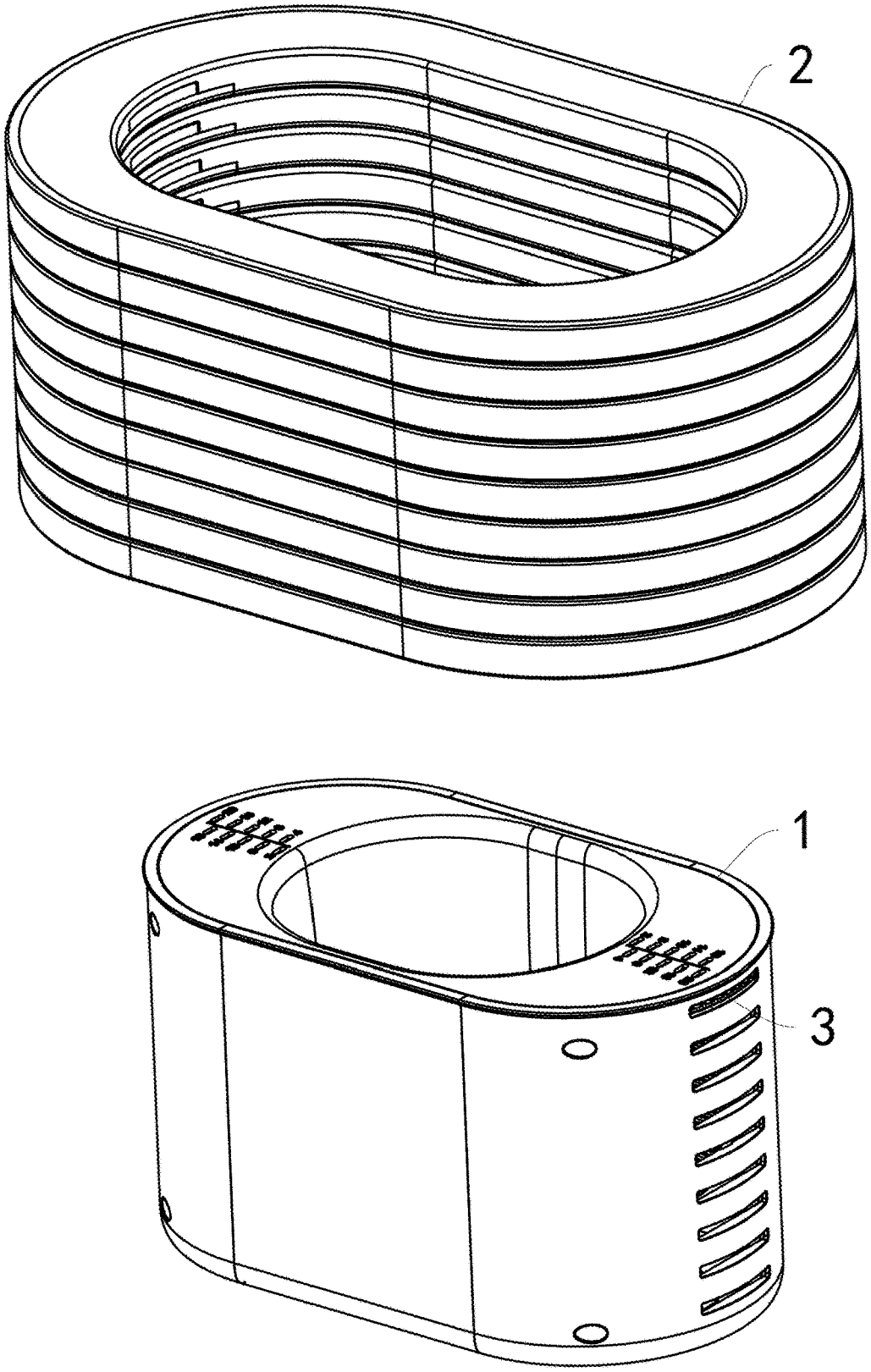
FIG. 2 is an explosion structural schematic diagram of the adjustable dumbbell.
Figure 3:
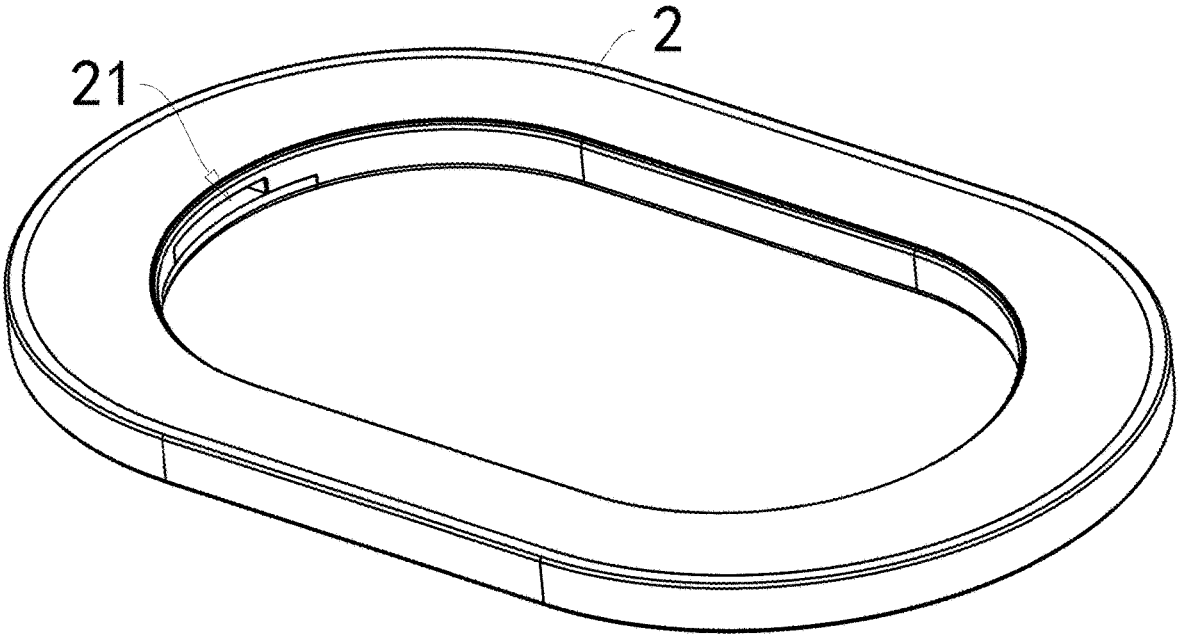
FIG. 3 is a schematic structural diagram of a dumbbell piece of the adjustable dumbbell.

This application discloses a novel adjustable dumbbell and a dumbbell kit. Referring to FIGS. 1, 2, and 3, the adjustable dumbbell includes a dumbbell body 1, a plurality of dumbbell pieces 2, and an adjusting mechanism 3. Each of the dumbbell pieces 2 is cumulatively provided on the dumbbell body 1, and dumbbell grooves 21 are provided on two sides of each of the dumbbell pieces 2. The adjusting mechanism 3 is provided inside the dumbbell body 1.

Figure 4:
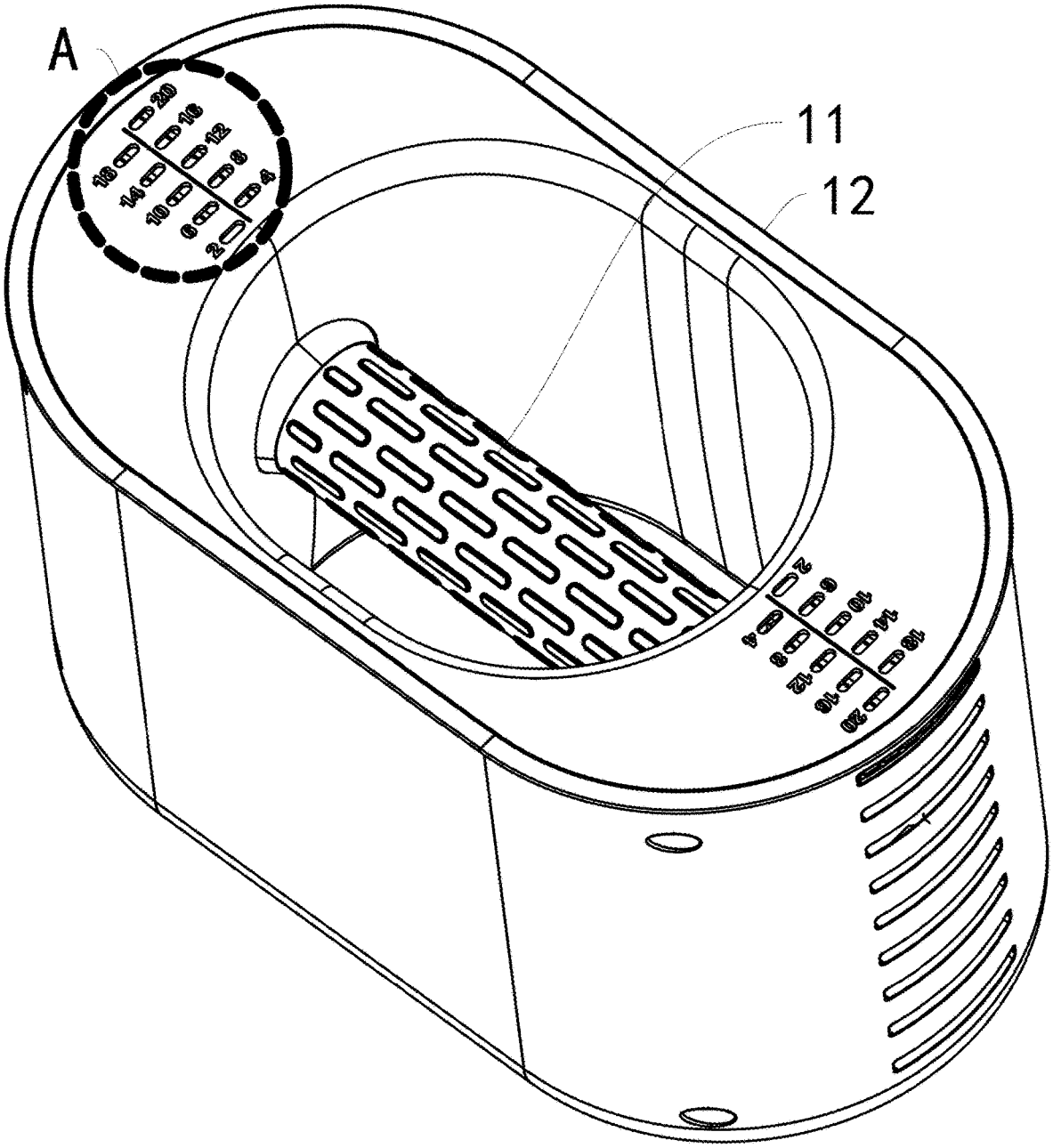
FIG. 4 is a main structure schematic diagram of the adjustable dumbbell.

Referring to FIG. 4, the dumbbell body 1 includes a dumbbell grip rod 11 and dumbbell shells 12. The dumbbell grip rod 11 is cylindrical, and the dumbbell shells 12 are sleeved on the two ends of the dumbbell grip rod 11, so that the dumbbell grip rod 11 is located in a middle of the dumbbell shells 12. A top view of the dumbbell shells 12 is a hollow waist shape in the middle thereof. In this embodiment of the present application, an axis direction of the dumbbell grip rod 11 is arranged as an axis direction, a height direction of the dumbbell shells 12 is arranged as a vertical direction, and a straight-line direction on two curved-shape sides of the dumbbell shells 12 is arranged as a length direction.

Figure 5:
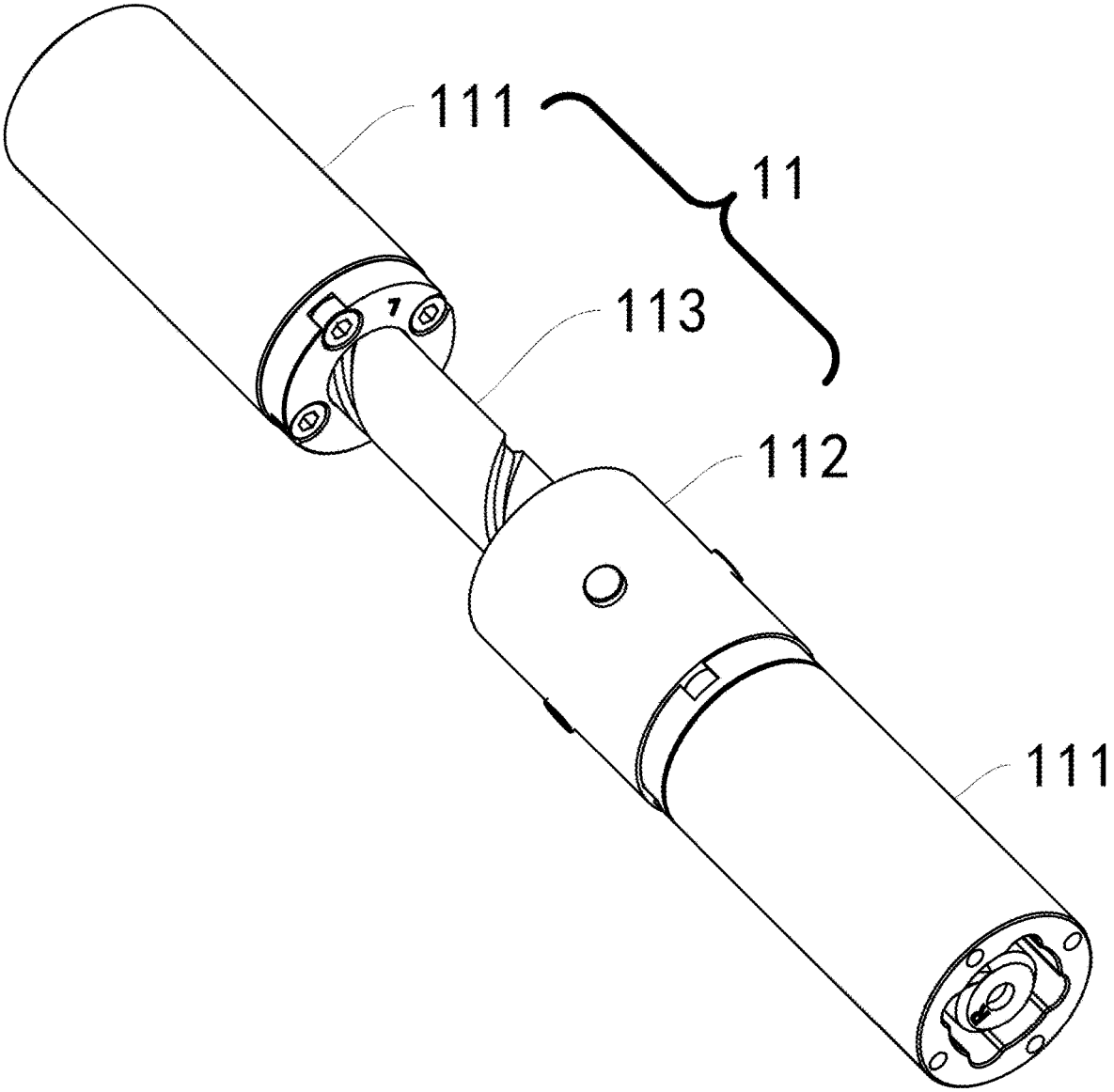
FIG. 5 is a schematic diagram of a dumbbell grip rod of the adjustable dumbbell.

Referring to FIG. 5, the dumbbell grip rod 11 includes two sliding rods 111, a central rod 112, and two threaded rods 113. The two sliding rods 111 are located on the two sides of the dumbbell shells 12 in the length direction, and the two sliding rods 111 slide and fit inside the dumbbell shells 12 along the length direction. The central rod 112 is provided on the dumbbell shells 12, and the two threaded rods 113 are fixedly connected to two ends of the central rod 112. The two threaded rods 113 are respectively passes through the middle positions inside the two sliding rods 111, and the two threaded rods 113 are respectively connected to the two sliding rods 111 by threads, so that the central rod 112 is rotatably provided on the dumbbell shells 12. At the same time, when the central rod 112 is rotated relative to the dumbbell shells 12 around the axis direction, the two threaded rods 113 are rotated simultaneously, and the two threaded rods 113 drive the two sliding rods 111 to slide towards or away from the dumbbell shells 12.

Figure 6:
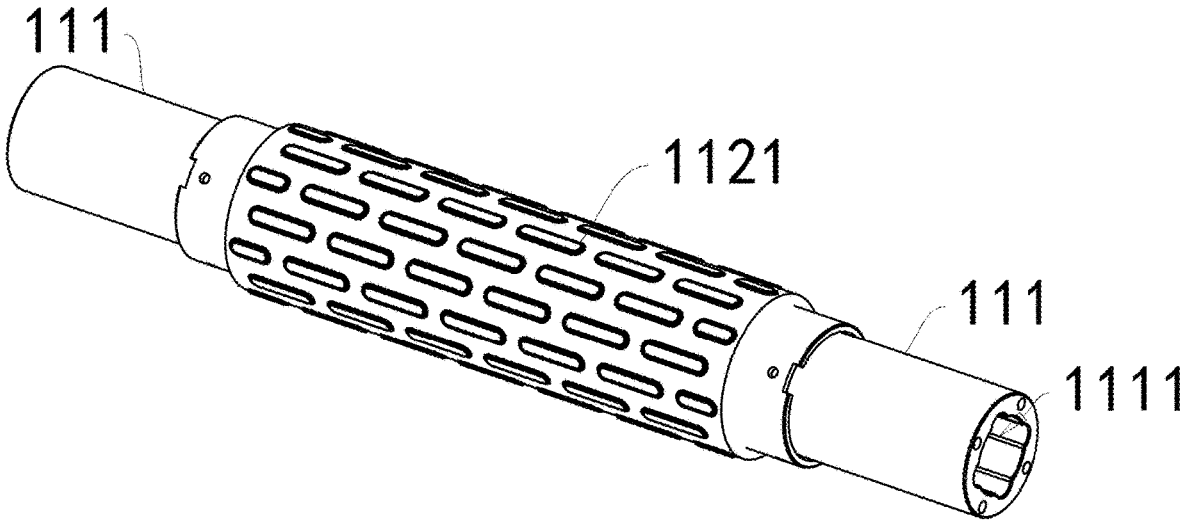
FIG. 6 is a schematic structural diagram of a center rod of the adjustable dumbbell.

Referring to FIG. 6, an outer peripheral surface of the central rod 112 is fixedly connected with a friction sleeve 1121, and the friction sleeve 1121 is configured to increase a frictional force on the outer peripheral surface of the central rod 112.

Figure 7:
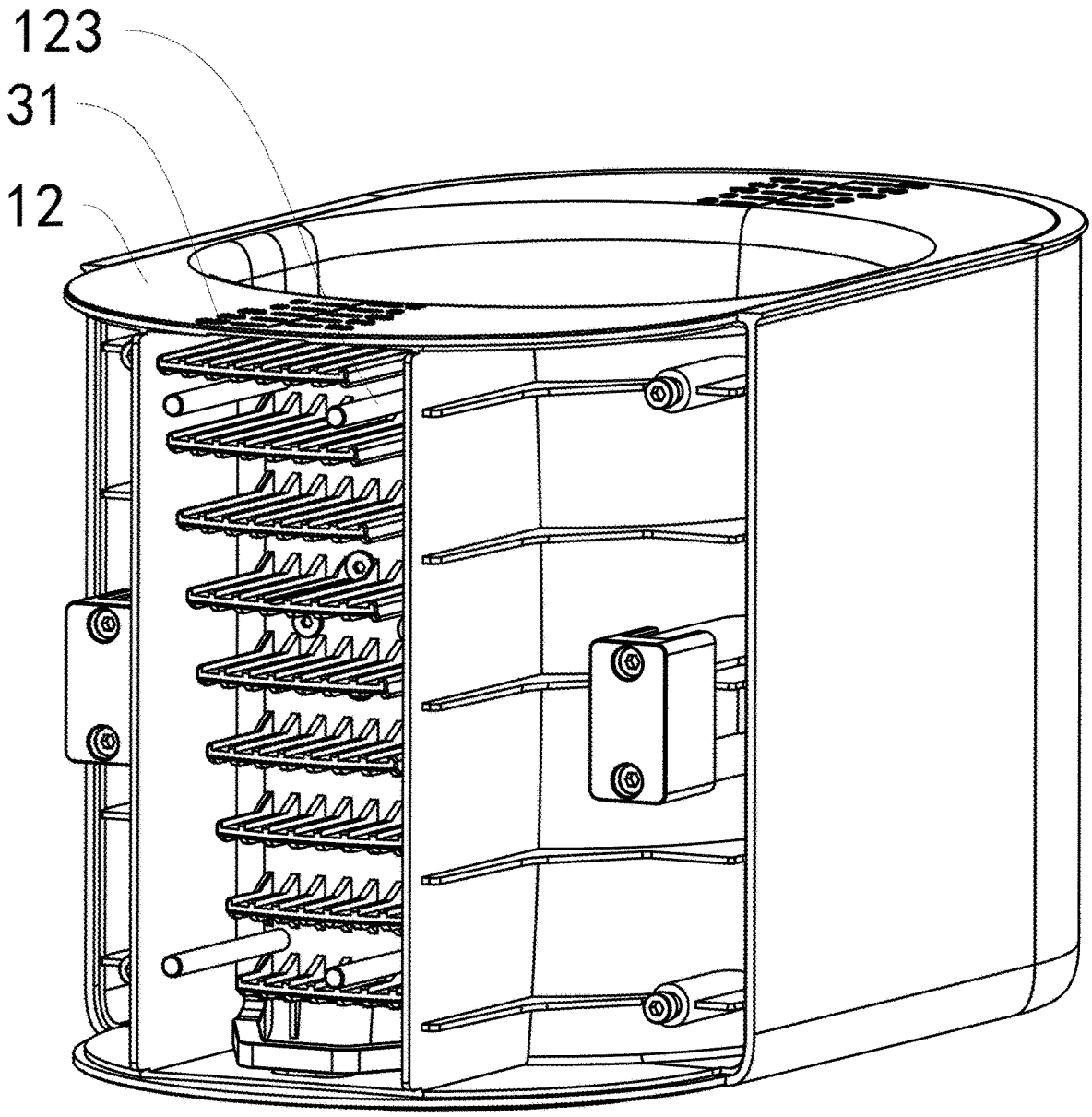
FIG. 7 is a schematic structural diagram of dumbbell shells of the adjustable dumbbell.
Figure 8:
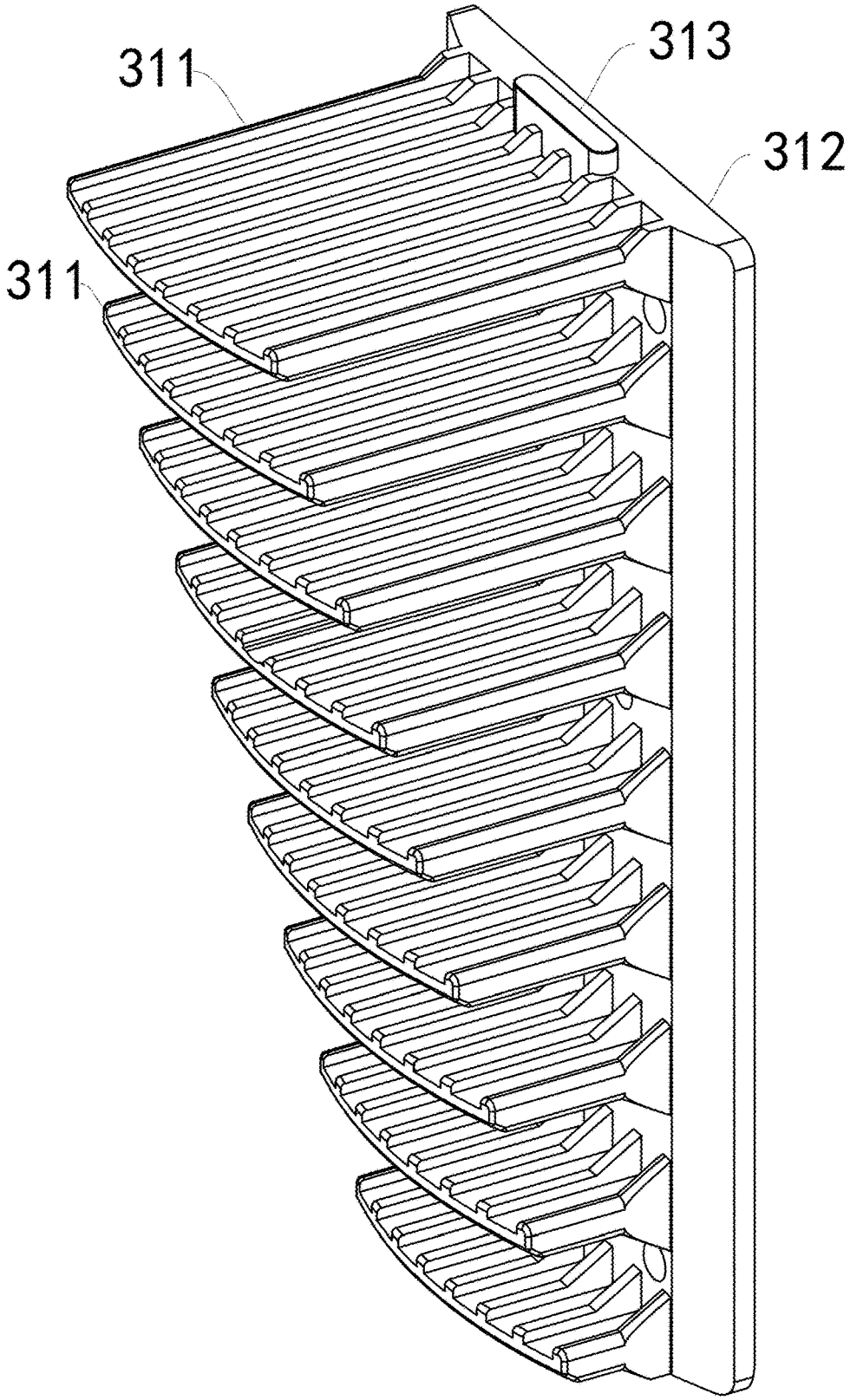
FIG. 8 is a schematic structural diagram of an adjusting portion of the adjustable dumbbell.

Referring to FIGS. 7 and 8, the adjusting mechanism 3 includes two adjusting blocks 31, and the two adjusting blocks 31 slide along the length direction and fit on two curved-shape sides of the dumbbell shells 12. The two adjusting blocks 31 are arranged facing each other, and the two adjusting blocks 31 both include a plurality of adjusting portions 311 and fixing portions 312. The number of the adjusting portions 311 corresponds to the number of the dumbbell pieces 2, and each of the adjusting portions 311 is fixedly connected to one side of each of the fixing portions 312. The fixing portions 312 are rectangular in shape, and each of the adjusting portions 311 is distributed along the length direction of the fixing portions 312. Each of the adjusting portions 311 is aligned with each of the dumbbell grooves 21 on one side of each of the dumbbell pieces 2, and when each of the dumbbell pieces 2 is cumulatively installed on the dumbbell body 1, the corresponding adjusting portions 311 of the two adjusting blocks 31 are respectively passed through corresponding two dumbbell grooves 21 of each of the dumbbell pieces 2.

The dumbbell shells 12 are fixedly provided with a plurality of sliding columns 123, and the fixing portions 312 are provided with a plurality of sliding holes that are penetrated. When the fixing portions 312 are provided on the dumbbell shells 12, each of the sliding columns 123 is respectively threaded and slidably fit into each of the sliding holes, so that the adjusting blocks 31 slide along the length direction to fit with the two curved-shape sides of the dumbbell shells 12, thereby improving the stability of the sliding fit between the adjusting blocks 31 and the dumbbell shells 12.

Referring to FIGS. 7 and 8, a length of each of the adjusting portions 311 gradually increases or decreases from one end of the fixing portions 312 in the length direction to the other end of the fixing portions 312 in the length direction. In the embodiments of the present application, the length of each of the adjusting portions 311 gradually decreases from one side of the fixing portions 312 close to a top of the dumbbell shells 12 to one side of the fixing portions 312 close to a bottom of the dumbbell shells 12, so that when each of the dumbbell pieces 2 is cumulatively installed on the dumbbell body 1, each of the dumbbell pieces 2 gradually installed on the dumbbell body 1 from the side near the top of the dumbbell shells 12 towards the side near the bottom of the dumbbell shells 12, thereby making each dumbbell piece 2 to be more stably installed on the dumbbell body 1.

Figure 9:
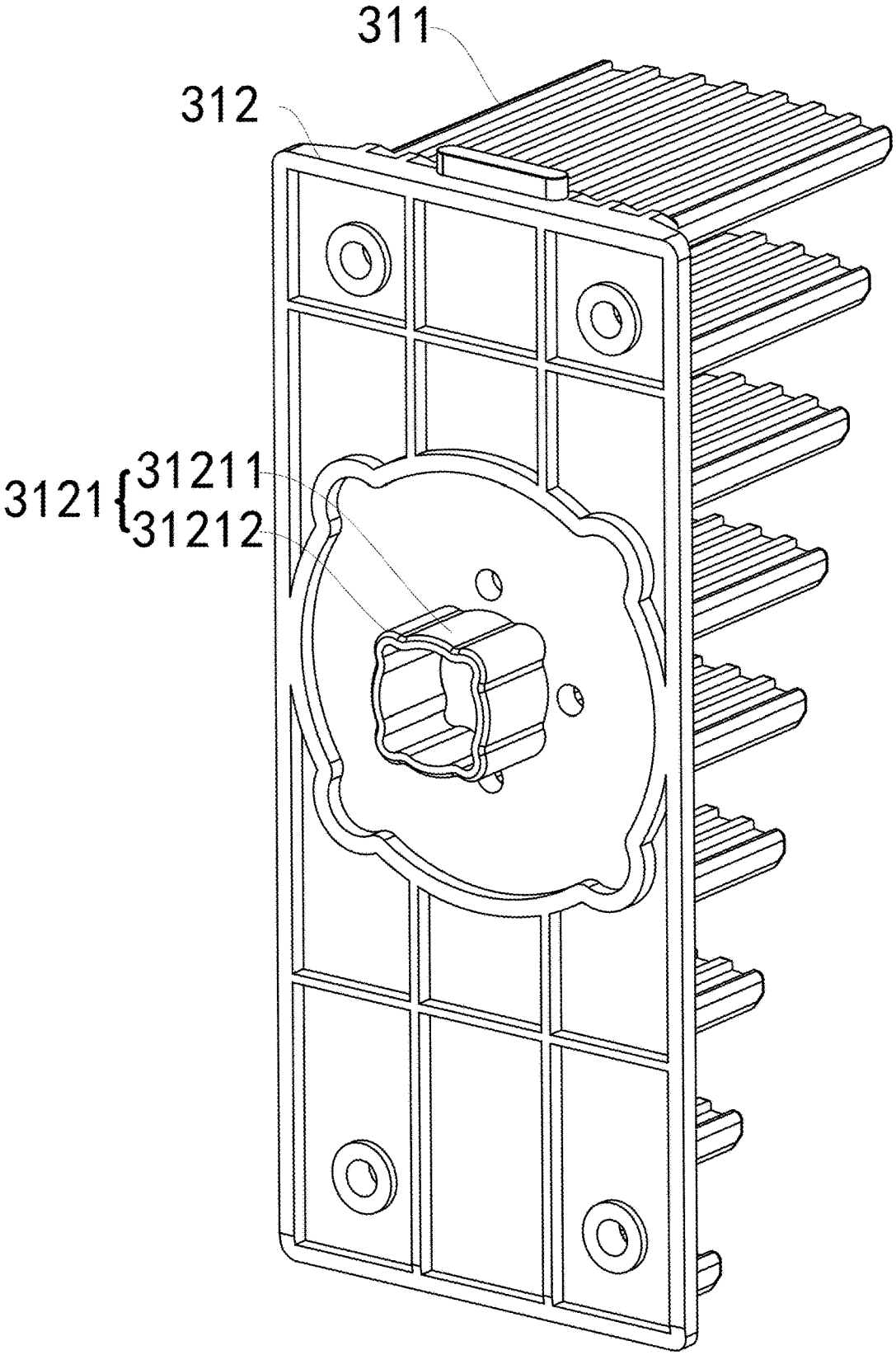
FIG. 9 is a schematic structural diagram of a fixing portion of the adjustable dumbbell.

Referring to FIG. 9, fixing convex blocks 3121 are fixedly provided on one side of each of the two fixing portions 312 adjacent to the two sliding rods 111. The fixing convex blocks 3121 include four first arc-shaped portions 31211 and four second arc-shaped portions 31212. Each of the first arc-shaped portions 31211 and each of the second arc-shaped portions 31212 are fixedly connected in a closed ring shape in a staggered manner, thereby forming the fixing convex blocks 3121. In this embodiment of the present application, a radius of each of the first arc-shaped portions 31211 is larger than that of each of the second arc-shaped portions 31212, and fixing grooves 1111 are provided on one side of the two sliding rods 111 adjacent to the two fixing portions 312. When the fixing portions 312 and the sliding rods 111 are fixedly connected, the fixing convex blocks 3121 are inserted and clamped into the fixing grooves 1111, thereby making the fixing convex blocks 3121 to be passed through and being clamped into the fixing grooves 1111. When the fixing portions 312 are fixedly connected to the sliding rod 111, a relative rotation between the fixing portions 312 and the sliding rod 111 is less likely to occur. Thus, the connection stability between the fixing portions 312 and the sliding rod 111 is improved.

Figure 10:
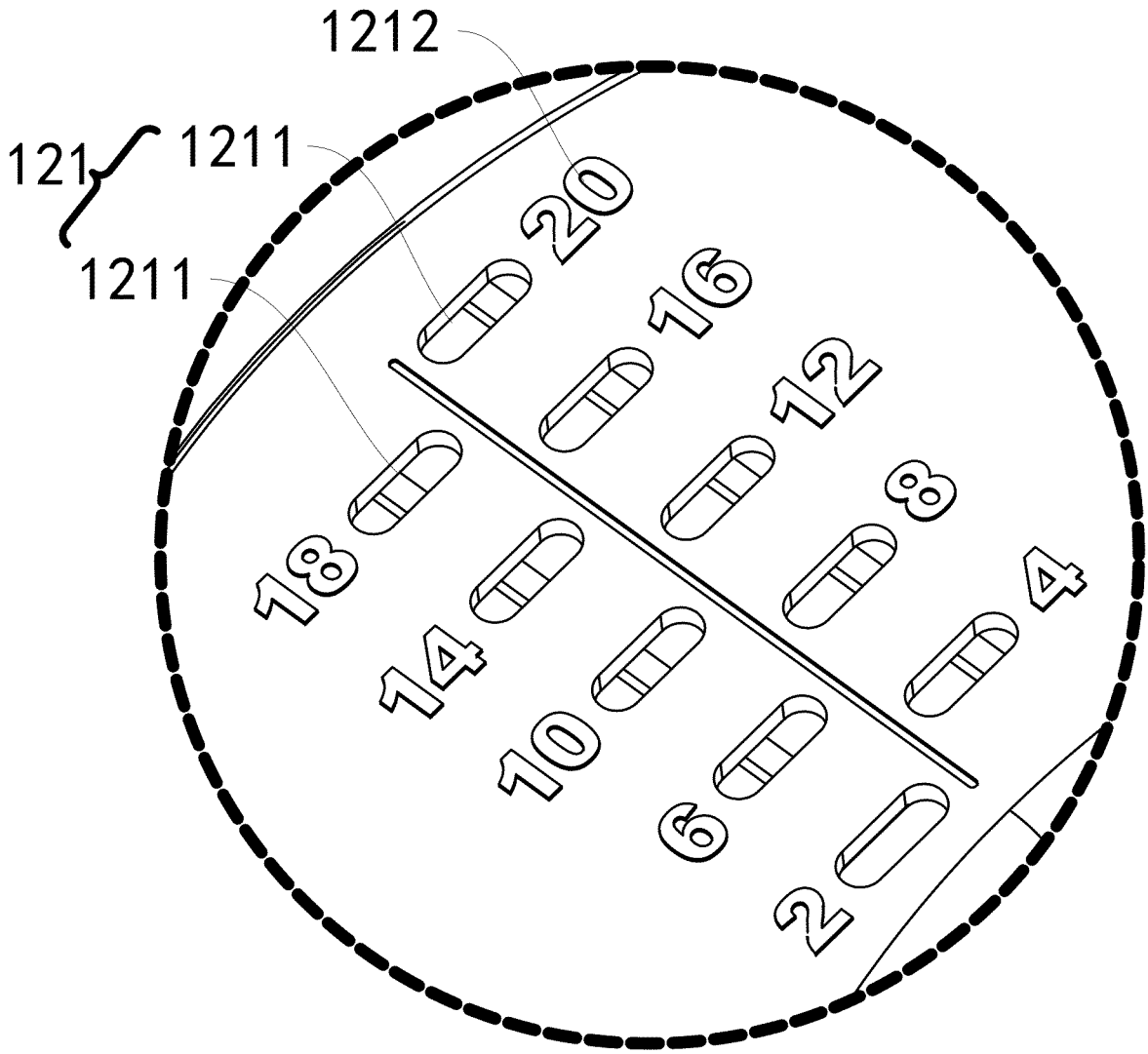
FIG. 10 is an enlarged view of part A of FIG. 4.

Referring to FIG. 10, two sets of scale holes 121 that are penetrated are provided on the top of the dumbbell shells 12. The two sets of scale holes 121 correspond to the two adjusting blocks 31, and the scale holes 121 include a plurality of scale portions 1211 that are penetrated. The number of the scale portions 1211 corresponds to the number of the dumbbell pieces 2. One side of each of the scale portions 1211 is engraved with an adjusting scale 1212 value indicating different adjustment weights of the dumbbell. To visually represent the adjustment weight of the dumbbell, tops of the two adjusting blocks 31 are fixedly connected to a scale block 313. When the adjusting blocks 31 slide towards or away from the dumbbell shells 12, the scale block 313 moves along a length direction towards or away from the dumbbell shells 12. When the scale block 313 is directly facing any scale portion 1211, the user can observe the scale portions 1211 of the scale block 313, the adjusting scale 1212 on one side of the scale portions 1211 is configured to the weight of the adjustable dumbbell at this time. This enables users to quickly determine the weight of the adjustable dumbbell, rendering it easier for users to adjust the weight of the adjustable dumbbell to the desired weight.

Figure 11:
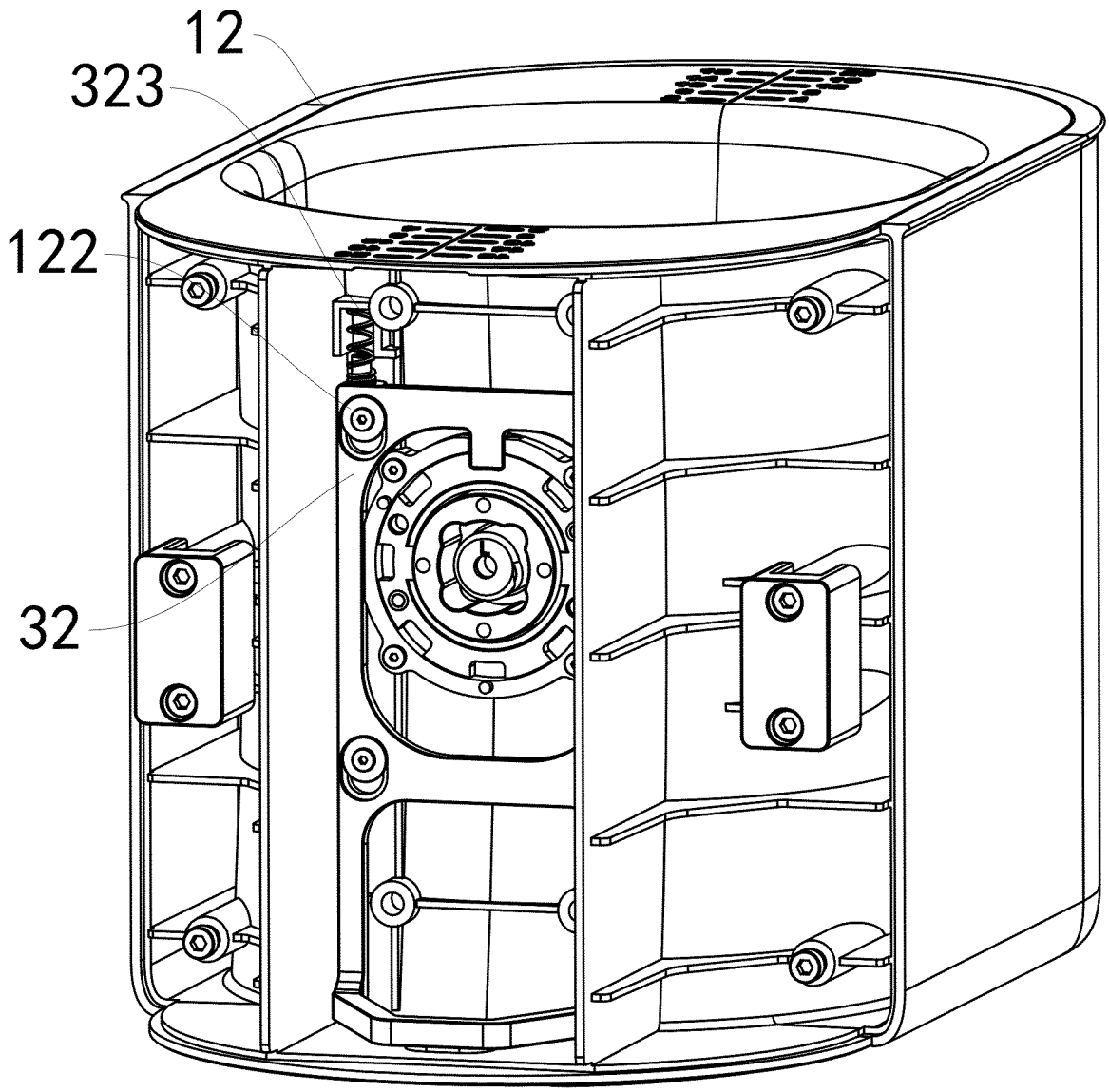
FIG. 11 is an installation schematic diagram of a locking component of the adjustable dumbbell.
Figure 12:
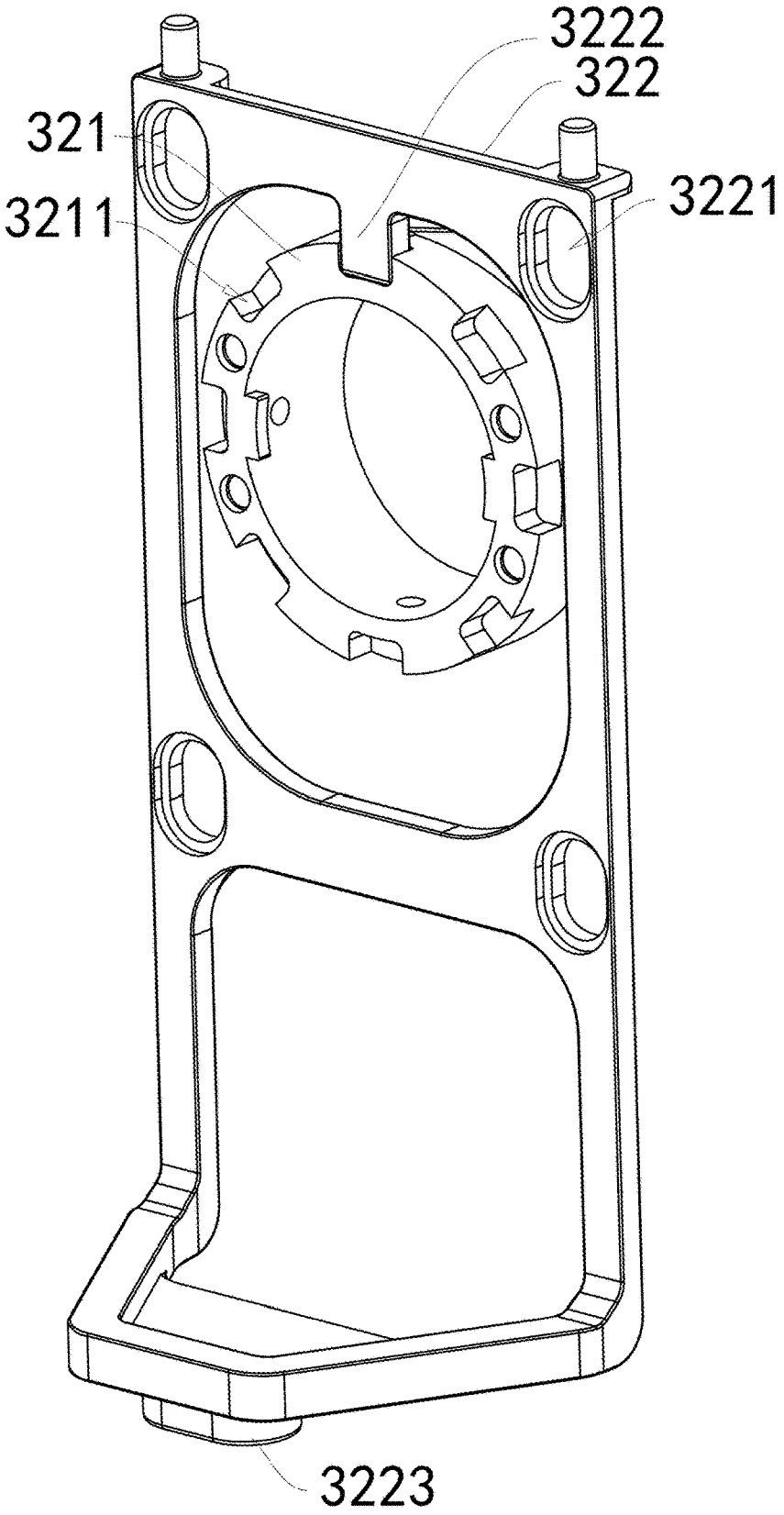
FIG. 12 is a schematic structural diagram of the locking component of the adjustable dumbbell.

Referring to FIGS. 11 and 12, the adjusting mechanism 3 further includes two sets of locking components 32, and the locking components 32 are respectively arranged on two sides of of the dumbbell shells 12 in the length direction. The locking components 32 include a locking wheel 321, a locking block 322, and two locking springs 323. The locking wheel 321 is coaxially fixed at one end of the central rod 112, and an outer circumference of the locking wheel 321 is provided with a plurality of locking slots 3211, and the locking slots 3211 are evenly distributed around an axis of the locking wheel 321 in a circumference direction. The locking block 322 is provided with a plurality of sliding grooves 3221 that are penetrated, and the length direction of each of the sliding grooves 3221 is arranged along the vertical direction. The dumbbell shells 12 are internally fixed with a plurality of fixing blocks 122, and each of the fixing blocks 122 is penetrated and slidably fit with each of the sliding grooves 3221, allowing each locking block 322 to slide vertically and fit with the dumbbell shells 12. The locking block 322 is fixedly connected to a locking protrusion 3222. When the locking component 32 is locked, the locking protrusion 3222 is inserted and clamped into any locking slot 3211 to fix the center rod 112 and the dumbbell shells 12. A bottom of the locking block 322 is fixedly connected to an unlocking protrusion 3223, and the bottom of the dumbbell shells 12 is provided with an unlocking groove that is penetrated. The unlocking protrusion 3223 is inserted and slidably fitted with the unlocking groove. The two locking springs 323 are located between the locking block 322 and the dumbbell shells 12, with one end of each of the two locking springs 323 fixedly connected to the locking block 322 and the other end of each of the two locking springs 323 fixedly connected to the dumbbell shells 12.

Figure 13:
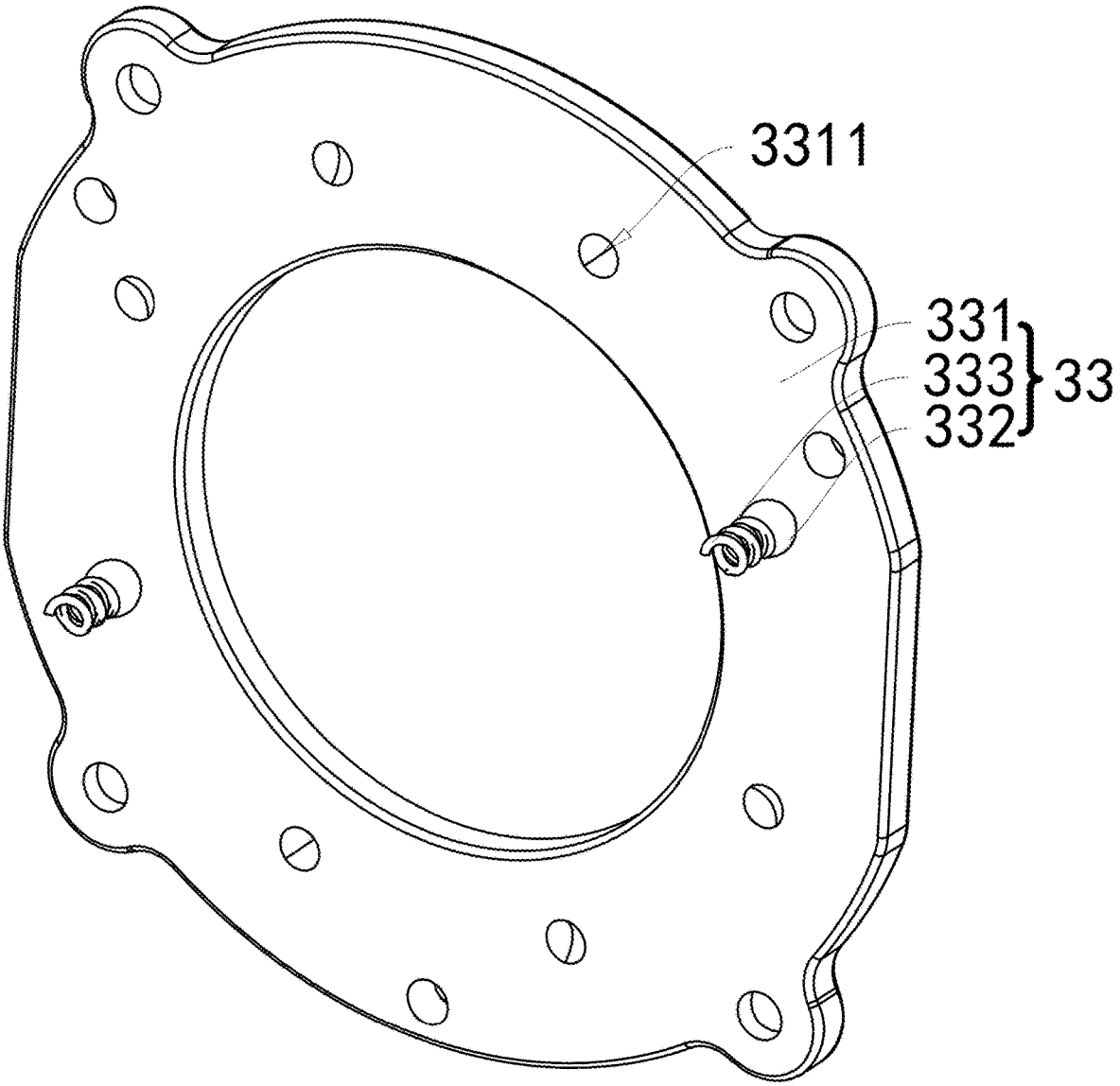
FIG. 13 is a schematic structural diagram of a shifting component of the adjustable dumbbell.

Referring to FIG. 13, the adjusting mechanism 3 further includes two sets of shifting components 33, and the shifting components 33 are respectively provided on two sides of the dumbbell shells 12 in the length direction. The shifting components 33 include a shifting wheel 331, two shifting balls 332, and two shifting springs 333. The shifting wheel 331 is fixedly arranged at one end of the dumbbell shells 12 near the sliding rod 111, and the shifting wheel 331 is coaxially arranged with the sliding rod 111. The shifting wheel 331 is provided with a plurality of shifting holes 3311, and each of the shifting holes 3311 is distributed around an axis of the shifting wheel 331 in a circumference direction. The two shifting balls 332 slide and cooperate with the locking wheel 321 along the axis direction. The two shifting balls 332 are evenly distributed around the axis of the locking wheel 321, and the two shifting balls 332 are respectively engaged with the two shifting holes 3311. One end of each of the shifting springs 333 is fixedly connected to the locking wheel 321, and the other ends of the two shifting springs 333 are respectively connected to the two shifting balls 332. When adjusting the weight of the adjustable dumbbell, the two shifting balls 332 are detached from two opposing shifting holes 3311 and pass through another two opposing shifting holes 3311. During a process of disengaging from the shifting holes 3311 and re-engaging with the shifting holes 3311, a "click" sound is made, indicating to the user that the weight adjustment of the adjustable dumbbell has been completed.

The implementation principle of the adjustable dumbbell in this application is as follows: when adjusting the weight of the dumbbell, the adjusting blocks 31 are driven to slide in a direction away from the dumbbell body 1, so that the adjusting portions 311 that need to accumulate the number of the dumbbell pieces 2 are respectively passed through each of the dumbbell grooves 21, so that the required dumbbell pieces 2 are accumulated and installed in the dumbbell body 1, thereby quickly completing the weight adjustment of the adjustable dumbbell. Although the adjustable dumbbell achieves weight adjustment, it requires the user to first detach the dumbbell grip rod 11 from the dumbbell shells 12, and then determine the position of the adjusting hole for the dumbbell grip rod 11 to be passed through according to required weight of the adjustable dumbbell, which makes it difficult and laborious to adjust the weight of the dumbbell, resulting in low efficiency in frequent weight adjustment of the dumbbell and affecting the exercise effect of using the dumbbell.

As can be seen from the above, when the central rod 112 and the sliding rod 111 can rotate relative to each other, that is, when the central rod 112 and the dumbbell shells 12 can rotate relative to each other, the locking component 32 needs to be unlocked. When the locking component 32 is unlocked, the locking protrusion 3222 needs to be disengaged from the locking slot 3211.

Figure 14:
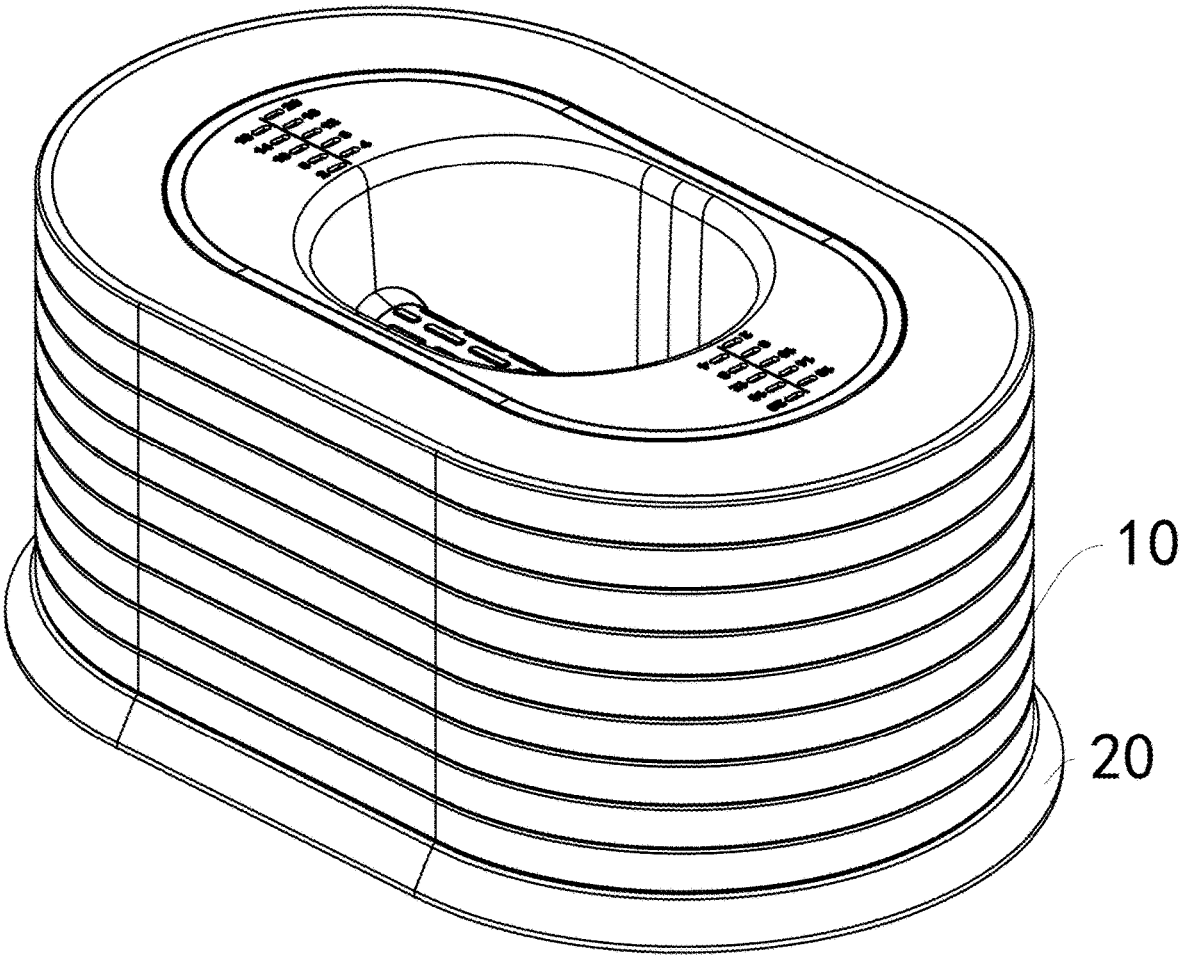
FIG. 14 is a schematic diagram of an overall structure of a dumbbell kit.
Figure 15:
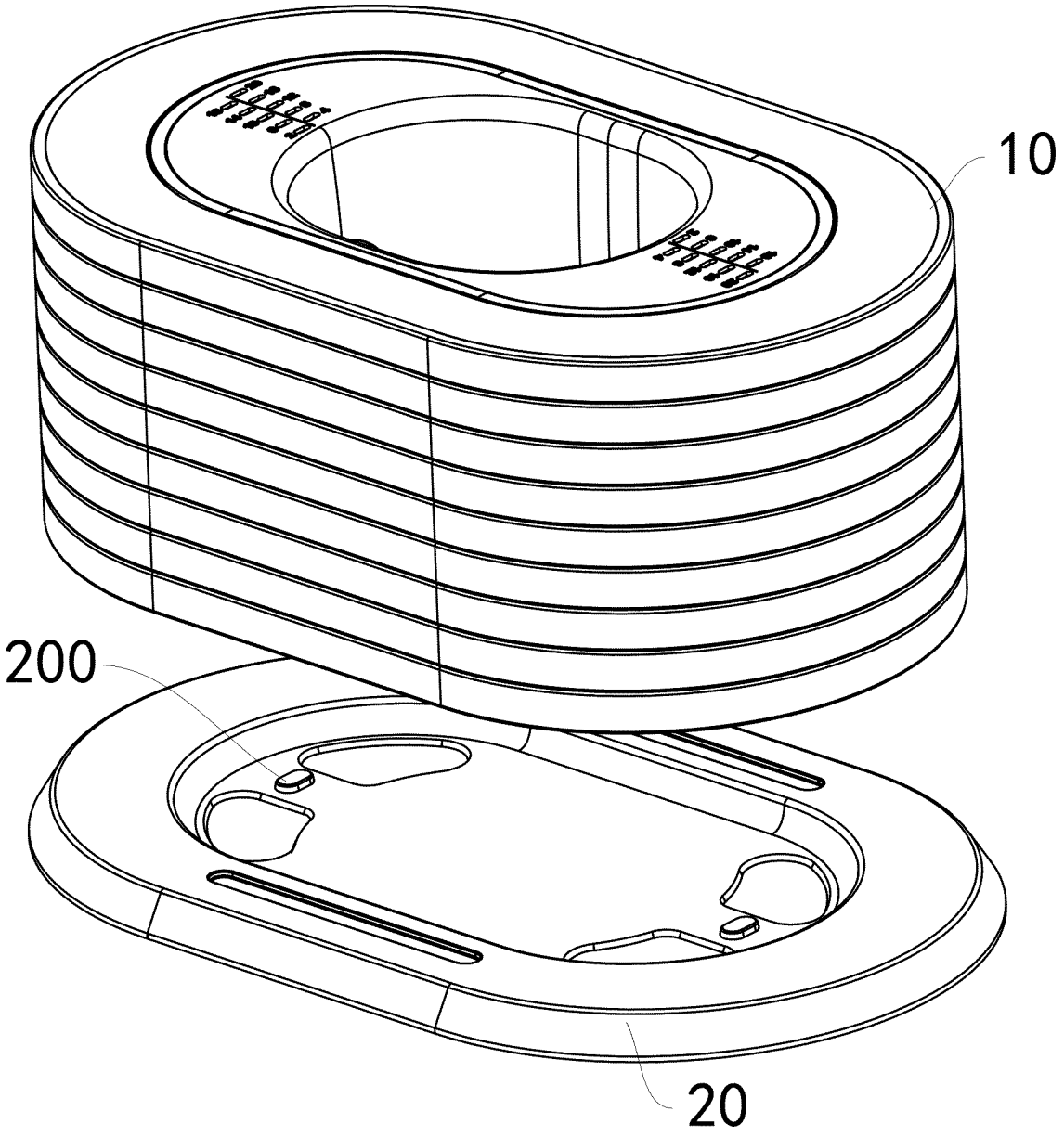
FIG. 15 is a first explosion schematic diagram of the dumbbell kit.
Figure 16:
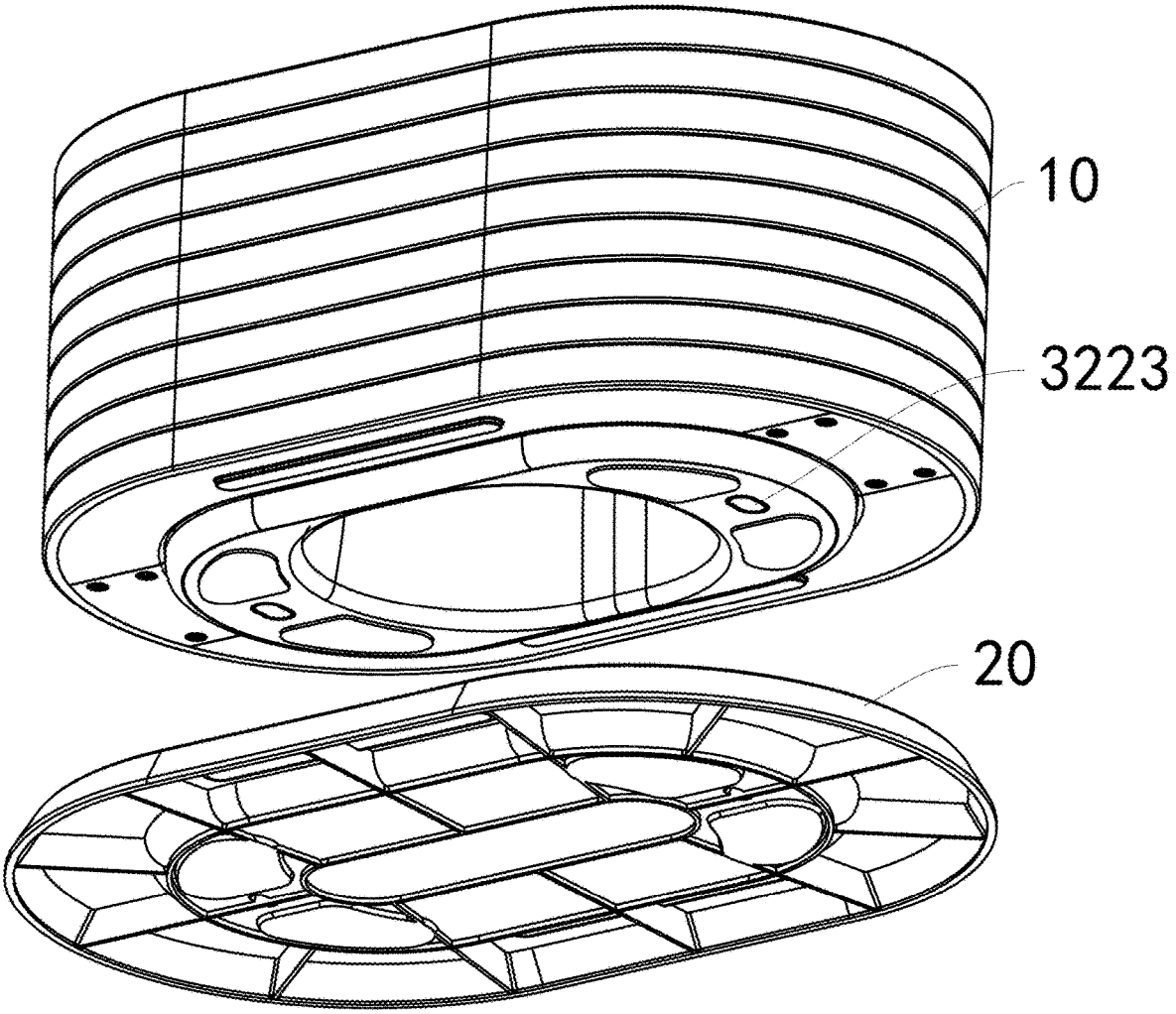
FIG. 16 is a second explosion schematic diagram of the dumbbell kit.

Therefore, this embodiment further provides a dumbbell kit, referring to FIGS. 14, 15, and 16. The dumbbell kit includes an adjustable dumbbell 10 and a dumbbell seat 20 configured to place the adjustable dumbbell 10. The dumbbell seat 20 is provided with a placement groove, and two unlocking blocks 200 configured to unlock the locking component 32 are fixedly arranged in the placement groove. The two unlocking blocks 200 are respectively facing the two unlocking protrusions 3223. When the adjustable dumbbell 10 is placed in the placement groove, the two unlocking blocks 200 are respectively in contact with the two unlocking protrusions 3223, and the two unlocking blocks 200 push the two unlocking protrusions 3223 to slide in the vertical direction towards the direction closer to the dumbbell shells 12 under the weight of the adjustable dumbbell 10, thereby driving the locking blocks 322 to move away from the locking wheel in the vertical direction, the locking protrusion 3222 are caused to disengage from the locking slot 3211, thereby unlocking the locking component 32. Thus, the central rod 112 and the sliding rod 111 can rotate relative to each other to complete the weight adjustment of the adjustable dumbbell 10. When the adjustable dumbbell 10 completes the weight adjustment and is lifted for exercise, the two unlocking blocks 200 respectively disengage from the two unlocking protrusions 3223, and the locking spring 323 drives the locking block 322 to reset, so that the locking protrusion 3222 re-engages with the locking slot 3211, thereby locking the locking component 32 and fixing the central rod 112 and the sliding rod 111 relative to each other. This makes it difficult to adjust the weight of the adjustable dumbbell 10 during use, thereby making it more stable to use the adjustable dumbbell 10.

The above are preferred embodiments of the present application and do not limit the protection scope of the present application. Therefore, any equivalent changes made according to the structure, shape, and principle of the present application should be included in the protection scope of the present application.

What is claimed is:

1. An adjustable dumbbell, comprising:

a dumbbell body, wherein the dumbbell body comprises a dumbbell grip rod and dumbbell shells that are sleeved on two ends of the dumbbell grip rod and connected to the two ends of the dumbbell grip rod;

one or more dumbbell pieces that are provided on the dumbbell body, wherein each of the dumbbell pieces is provided with one or more dumbbell grooves; and an adjusting mechanism, which is provided on the dumbbell body, and the adjusting mechanism comprises one or more adjusting blocks, the adjusting blocks comprise one or more adjusting portions, the number of the adjusting portions corresponds to the number of the dumbbell pieces, and each of the adjusting portions cooperates with the dumbbell shells;

when the adjusting blocks slide away from the dumbbell body, each of the adjusting portions is inserted into corresponding dumbbell groove of each of the dumbbell pieces, so that the dumbbell pieces are accumulated on the dumbbell body.

2. The adjustable dumbbell according to claim 1, wherein the adjusting blocks further comprise fixing portions, and the fixing portions are slidably fitted to the dumbbell shells, each of the adjusting portions is fixedly provided on the fixing portions, and the adjusting portions are distributed along a length direction of the fixing portions.

3. The adjustable dumbbell according to claim 2, wherein a length of each of the adjusting portions gradually increase or decrease from one end of the fixing portions to the other end of the fixing part in a length direction.

4. The adjustable dumbbell according to claim 2, wherein the dumbbell grip rod comprises one or two sliding rods, each of the sliding rods is slidably fitted to the dumbbell shells;

when each of the sliding rods slides towards or away from the dumbbell body, each of the adjusting blocks slides towards or away from the dumbbell body;

a central rod is rotatably provided on the dumbbell shells;

one or two threaded rods, each of the one or two threaded rods is fixedly connected to the central rod; when the central rod is rotated, each of the threaded rods is rotated, and each of the threaded rods passes through and connected to each of the sliding rods.

5. The adjustable dumbbell according to claim 4, wherein the number of the adjusting blocks corresponds to the number of the sliding rods, the fixing portions are fixedly provided with a fixing convex block, the sliding rod is provided with a fixing groove, and when the fixing portions are fixedly connected to the sliding rod, the fixing convex block is inserted and clamped into the fixing groove.

6. The adjustable dumbbell according to claim 5, wherein the adjusting mechanism further comprises a shifting component, wherein the shifting component comprises:

a shifting wheel that is fixedly provided on the dumbbell shells, and the shifting wheel is provided with a plurality of shifting holes, each of the shifting holes is distributed around an axis of the shifting wheel in a circumferential direction;

one or more shifting balls, and the shifting balls slide along an axis direction and fit on the central rod, and are configured to engage with any of the shifting holes; and shifting springs, the number of the shifting springs corresponds to the number of the shifting balls, one end of each of the shifting springs is connected to the center rod, and the other end of each of the shifting springs is connected to the shifting balls;

when adjusting a weight of the dumbbell, the shifting balls are disengaged from one shifting hole and pass through another shifting hole.

7. The adjustable dumbbell according to claim 1, wherein the dumbbell shells are provided with a plurality of sets of scale holes that are penetrated, the number of the scale holes corresponds to the number of the adjusting blocks, the scale holes comprise a plurality of scale portions, and the number of the scale portions corresponds to the number of the dumbbell pieces;

one side of each of the scale portions is engraved with adjusting scales of different weights;

each of the adjusting blocks is fixedly connected to a scale block, and when the scale block faces any one scale portion, an adjusting scale on the side facing the scale portions is the weight of the adjustable dumbbell.

8. The adjustable dumbbell according to claim 4, wherein the adjusting mechanism further comprises a locking component, the locking component comprises:

a locking wheel, and the locking wheel is coaxially fixed on the central rod and is provided with a plurality of locking grooves, and each of the locking grooves is distributed around an axis of the locking wheel in a circumferential direction; and a locking block, and the locking block slides along a vertical direction and fits with the dumbbell shells; the locking block is fixedly connected to a locking protrusion; when the locking component is locked, the locking protrusion is inserted and clamped into any of the locking slots to fix the center rod and the dumbbell shells.

9. A dumbbell kit, comprising an adjustable dumbbell and a dumbbell seat configured to place the adjustable dumbbell, wherein the adjustable dumbbell is the adjustable dumbbell according to claim 1, and the dumbbell seat is provided with a placement groove configured to place the adjustable dumbbell.

10. The dumbbell kit according to claim 9, wherein an unlocking block configured to unlock the locking component is provided in the placement groove, and when the adjustable dumbbell is placed on the dumbbell seat, the unlocking block contacts the locking block and pushes the locking block to be away from the locking wheel, so that the locking protrusion disengages from the locking slot so as to unlock the locking component.

* * * * *